US005458737A

United States Patent [19]

Diaddario, Jr.

[11] Patent Number: 5,458,737

[45] Date of Patent: Oct. 17, 1995

[54] QUATERNARY COMPOUNDS AS BRIGHTNESS ENHANCERS

[75] Inventor: Leonard L. Diaddario, Jr., Fort Mill, S.C.

[73] Assignee: Hoechst Celanese Corporation, Somerville, N.J.

[21] Appl. No.: 97,696

[22] Filed: Jul. 27, 1993

[51] Int. Cl.[6] ..... D21C 9/10

[52] U.S. Cl. ..... 162/72; 162/78; 162/81; 162/82

[58] Field of Search ..... 162/73, 72, 78, 162/74, 81, 183, 84, 87, 88, 82

[56] References Cited

U.S. PATENT DOCUMENTS

| | | | |
|---|---|---|---|
| 1,572,478 | 2/1926 | Hammond | 8/2 |
| 1,923,178 | 8/1933 | Ulrich et al. | 260/127 |
| 2,003,928 | 6/1935 | Evans et al. | 8/2 |
| 2,019,124 | 10/1935 | Evans et al. | 8/2 |
| 2,164,930 | 7/1939 | Lubs | 8/34 |
| 2,218,479 | 10/1940 | Peterson et al. | 92/9 |
| 2,248,128 | 7/1941 | Seymour et al. | 8/64 |
| 2,525,770 | 10/1950 | Cook et al. | 8/102 |
| 2,587,597 | 3/1952 | Cook et al. | 8/102 |
| 2,860,944 | 11/1958 | Young | 8/104 |
| 2,902,453 | 9/1959 | Matlin | 252/105 |
| 2,985,500 | 5/1961 | Janson et al. | 8/102 |
| 2,986,488 | 5/1961 | Weisgerber et al. | 162/158 |
| 3,074,774 | 1/1963 | Sapers et al. | 8/69 |
| 3,361,794 | 1/1968 | Wakeman et al. | 260/501.15 |
| 3,554,863 | 1/1971 | Hervey et al. | 162/158 |
| 3,591,325 | 7/1971 | Sapers | 8/102 |
| 3,617,439 | 11/1971 | Chapman | 162/158 |
| 3,666,409 | 5/1972 | Yoshikawa et al. | 23/116 |
| 3,956,165 | 5/1976 | Hansen et al. | 162/73 |
| 3,960,649 | 6/1976 | Sullivan | 162/72 |
| 4,013,505 | 3/1977 | Balcar et al. | 162/5 |
| 4,144,122 | 3/1979 | Emanuelsson et al. | 162/158 |
| 4,441,962 | 4/1984 | Osborn | 162/111 |
| 4,444,621 | 4/1984 | Lindahl | 162/78 |
| 4,557,801 | 12/1985 | Avis | 162/157.6 |
| 4,618,400 | 10/1986 | Wood et al. | 162/5 |
| 4,632,730 | 12/1986 | Ulubay et al. | 162/111 |
| 4,666,558 | 5/1987 | Wood et al. | 162/5 |
| 4,710,267 | 12/1987 | Elsby et al. | 162/5 |
| 5,013,404 | 5/1991 | Christiansen et al. | 162/72 |
| 5,129,987 | 7/1992 | Joachimides et al. | 162/25 |

FOREIGN PATENT DOCUMENTS

| | | | |
|---|---|---|---|
| 0429241 | 5/1991 | European Pat. Off. . | |
| 8225489 | 9/1976 | Japan . | |
| 55-22067 | 2/1980 | Japan | 162/72 |
| 3294576 | 12/1991 | Japan . | |
| 2045302 | 10/1980 | United Kingdom . | |

OTHER PUBLICATIONS

*Dyeing and Chemical Technology of Textile Fibers*, by E. R. Troutman (fifth edition, Charles Griffin and Co. Ltd., Great Britain, 1975).

C. R. Noller, *Textbook of Organic Chemistry* (W. B. Saunders Co., Philadelphia, Pennsylvania, 1966) at p. 224.

*Advanced Organic Chemistry*, J. March (third edition, John Wiley & Sons, New York, 1985) at pp. 364–368, 845.

*Primary Examiner*—Peter Chin

*Attorney, Agent, or Firm*—Rosemary M. Miano

[57] ABSTRACT

A process is disclosed for maximizing the brightness of wood pulps which have been treated with anionic bleaching agents wherein the brightness is enhanced by the use of selected quaternary ammonium compounds.

19 Claims, No Drawings

QUATERNARY COMPOUNDS AS BRIGHTNESS ENHANCERS

BACKGROUND OF THE INVENTION

This invention relates to maximizing the brightness of wood pulps bleached or brightened with bleaching agents, especially anionic bleaching agents so that brighter pulps may be obtained. This invention more particularly relates to maximizing the brightening of high-yield wood pulps used for newsprint and magazines.

Wood pulps can be classified as chemical pulps or high-yield pulps. Chemical pulps are prepared by chemically dissolving the non-cellulosic portion of the wood, such as lignins and hemicellulose. The process results in a purified wood pulp composed of 80–100 percent cellulose. High-yield wood pulps leave the bulk of the non-cellulosic components of the wood with the fiber because separation of the wood material into fibers occurs mainly through mechanical attrition of the wood, and contains up to about 60 percent cellulose.

High yield wood pulps are comprised of groundwood (GW) and refiner mechanical pulps (RMP). Stone groundwood pulp is produced by pressing logs against an abrasive rotating grindstone. Pressurized groundwood (PGW) is made by a modification to the stone grinding process; the logs are ground in a pressurized atmosphere to prevent the flashing of steam and to increase the temperature used in the grinding process.

Refiner mechanical pulps are produced by grinding wood chips between rotating grooved discs. Wood chips are introduced into the open eye of the refiner. As wood mass moves from the center of the refiner to the periphery, the wood is broken down into progressively smaller particles and finally into fibers.

Thermomechanical pulping (TMP) is a modification of the RMP process which involves steaming the wood chips for a short period of time prior to refining. Frequently both the heating and refining stages are done under pressure, but some pulping systems refine under atmospheric pressure (TRMP). Chemical treatments prior to refining or during the heating stage are further modifications of these pulping systems.

High-yield wood pulps are desirable for their low manufacturing costs and generally satisfactory physical properties. Their preparation involves very little loss of the original wood, and production processes typically are less expensive than chemical pulps. High-yield wood pulps are commonly used in newsprint, printing papers, molded products, corrugated paper, boxboards, and other applications.

While retaining the bulk of the wood material is economically favored, high-yield wood pulps tend to be dark and require bleaching in order to be used in certain applications. Various reducing and oxidizing agents may be used to brighten such high-yield wood pulps.

Oxidative bleaching with hydrogen peroxide generally produces higher brightness gains than those achieved with reductive bleaching processes. Brightness gains of 10–18 percentage points are attainable with hydrogen peroxide. The problem is that oxidative bleaching processes are more expensive than some of the other methods.

Reductive bleaching with compounds such as sodium dithionite (also called sodium hydrosulfite) or formamidine sulfinic acid (FAS) optionally in the presence of additives such as sodium tripolyphosphate, trisodiumnitrilotriacetate, and tetrasodium ethylenediaminetetraacetate also may be used. While reductive bleaching is usually cheaper, the brightness gains using these methods may be lower.

As will be appreciated by those skilled in the art, brightness is one of the most important product specifications in making commercially acceptable paper. When large brightness gains are not required, brightening with sodium dithionite bleaching is preferred over hydrogen peroxide because of cost. Manufacturers are under increasing pressure, however, to improve the brightness of their papers. Decreasing wood quality and environmental constraints have made these higher brightness targets more difficult to achieve. In balancing cost and need for increased brightness, many paper manufacturers are under increasing pressure to use the more expensive oxidative bleaching processes in order to meet the demand for acceptable products.

It is, therefore, an object of this invention to provide a process for obtaining enhanced bleaching of wood pulps in which reductive bleaches such as sodium hydrosulfite are used. It is a further object of the invention to extend the normal range of brightness gains for oxidative bleaches such as hydrogen peroxide.

SUMMARY OF THE INVENTION AND DESCRIPTION OF THE PREFERRED EMBODIMENT

It has been discovered that wood pulps bleached in the presence of selected quaternary ammonium compounds exhibit better brightness gains than those not containing such quaternary amine additives. More particularly, wood pulps bleached with anionic bleaching agents such as sodium dithionite, blends of sodium dithionite, zinc dithionite, hydrogen peroxide or formamidine sulfinic acid (FAS) (particularly sodium dithionite or hydrogen peroxide) will yield brighter pulps when the bleaching is done in the presence of a quaternary ammonium compound selected from the group consisting of (a) compounds of Formula I:

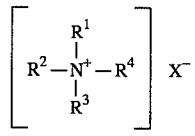

Formula I wherein:

$R^1$ is selected from the group consisting of hydrogen, methyl and ethyl, provided that $R^1$ cannot be hydrogen for peroxide bleaching;

$R^2$ and $R^3$ may be alike or different and are each selected from the group consisting of methyl and ethyl;

$R^4$ is an alkyl or alkenyl group having from 8 to 20 carbons, optionally having one to three substituents selected from methyl and ethyl;

X is selected from the group consisting of any suitable and convenient anion (for example, $X^-$ is selected from the group consisting of $HCO_3^{-1}$, $CO_3^{-2}$, $PO_4^{-3}$, $HPO_4^{-2}$, $H_2PO_4^{-1}$, $OH^{-1}$, $F^{-1}$, $Br^{-1}$, $Cl^{-1}$, $I^{-1}$, $HSO_3^{-1}$, $SO_3^{-2}$, $HSO_4^{-1}$, $SO_4^{-2}$, $SO_2O_{44}^{-2}$, $CH_3CO_3^{-1}$ and $CH_3SO_4^{-1}$);

(b) compounds of Formula II:

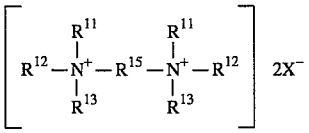

Formula II wherein:

$R^{11}$ is selected from the same group as described for $R^1$;

$R^{12}$ is selected from the same group as described for $R^2$;

$R^{13}$ is selected from the same group as described for $R^3$;

$R^{15}$ is an alkylene or alkenylene group having from 8 to 20 carbons, optionally having one to three substituents selected from methyl and ethyl; n is an integer from 8–20;

(c) compounds of Formula III:

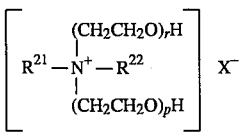

Formula III wherein $R^{21}$ is selected from the same group as defined for $R^4$;

$R^{22}$ is methyl or ethyl;

r and p each have a value of at least one and are selected independently and the sum of r+p equals an integer from 2 to 12 inclusive.

For compounds of Formula I, $R^1$ is preferably selected to be methyl or ethyl and is most preferably selected to be methyl. Preferred values for $R^2$ and $R^3$ are those where each is ethyl. A more preferred combination in one is which $R^2$ is methyl and $R^3$ is ethyl. The most preferred values for $R^2$ and $R^3$ are each methyl.

A more preferred range for each of $R^4$ and $R^{15}$ is a group containing 12–18 carbons and the most preferred range for each of these groups is a group containing 16–18 carbons.

While values for X include those listed above, a subgroup of interest from a practical standpoint is the group consisting of chloride, bromide, carbonate and bisulfate. Additionally, choices for selecting an appropriate value for X may further be limited to those members of the group which have reduced potential to cause corrosion problems.

More specific examples of suitable quaternary compounds include $CH_3(CH_2)_{11}N(CH_3)_2$, $[CH_3(CH_2)_3]_4NBr$, $CH_3(CH_2)_{11}N(CH_3)_3Br$, $CH_3(CH_2)_{15}N(CH_3)_3Br$, $[CH_3(CH_2)_{15}N(CH_3)_3]_2CO_3$, $[CH_3(CH_2)_{17}N(CH_3)_3]_2CO_3$, $CH_3(CH_2)_7N(CH_3)_2$, $CH_3(CH_2)_{11}N(CH_3)_3Br$, $CH_3(CH_2)_{15}N(CH_3)_2$ $(C_2H_5)Br$, $(CH_3)_3N(CH_2)_{10}N(CH_3)_3Br_2$, $C_5H_5N(CH_2)_{11}CH_3Cl$ and $CH_3(CH_2)_{15}N(CH_3)_3Br$.

The pulp on which the process of this invention may be used includes mechanical pulps (including TMP's which have been generally described above) and chemical pulps of the type produced by chemical pulping processes such as kraft or sulfite processes. In addition, kraft pulps which have been delignified may also be used in this invention. A particular application of interest is the use of the invention on high-yield pulps.

In practicing the method of this invention a selected quaternary compound of Formula I, II or III may be added to the reactor (for example, the bleach tower or possibly the refiner). The amount of quaternary ammonium compound used should be in an amount of from 0.25 percent to 10 percent by weight based on the amount of oven dried pulp in the reactor. A more particular range of addition is 0.5–5.0% by weight, and an even more particular range is 0.5–2.0% by weight. The quaternary ammonium compound may be added prior to the addition of the bleaching agent, at the same time as the bleaching agent, or right after the bleaching agent. Alternatively, the bleaching agent and the quaternary ammonium compound may be made up as a separate solution and then added to the pulp solution, for example, by pump into the bleaching tower.

General descriptions of bleaching methods for wood pulp made by mechanical processes may be found in the literature. By way of example, sodium hydrosulfite may be applied to such pulp in a dosage range of 0–3 percent based on the weight of oven dried pulp, with a particular range of 0.5–1 percent. The bleaching operation is usually carried out in the consistency range of 2–6 percent, with a particular value of 3.5 percent. A pH range of 4.5—6.5 offers a compromise between acid catalyzed decomposition of the sodium hydrosulfite and effective brightening, with a particular value being 5.5. Typically, bleaching is conducted at a temperature of 50–70 degrees C., with a particular value of 60 degrees C., and with a retention time of 30–120 minutes, with a particular value of 60 minutes.

For pulp bleached with hydrogen peroxide, the typical amount of hydrogen peroxide which is applied is in a dosage range of 0–5 percent (for a 50 percent solution of hydrogen peroxide) based on the weight of oven dried pulp, with a particular value being 1 percent. The usual pH range for bleaching with hydrogen peroxide is 8–11, with a particular value of 10.5. Typically, bleaching is conducted at a temperature of 35–60 degrees C., with a particular value being 55 degrees C., and with a retention time of 90–150 minutes, with a particular value being 135 minutes.

The method of this invention may be practiced in conjunction with the bleaching techniques familiar to those skilled in the art for hydrosulfite (such as zinc or sodium hydrosulfite, but preferably sodium hydrosulfite), FAS and hydrogen peroxide.

Compounds which form quaternary ammonium functional groups under the pH conditions used for bleaching have been found to enhance the brightness gains of wood pulps bleached with sodium hydrosulfite and/or hydrogen peroxide. The fact that the active bleaching species for sodium hydrosulfite and hydrogen peroxide are the hydrosulfite dianion and perhydroxyl anion, respectively, indicates that these types of compounds would enhance the performance of any anionic bleaching agent.

The increases in brightness obtained by using the method of this invention is significant and is on the order of 2–6 and 2–8 points.

The quaternary ammonium compounds used in this invention may be purchased commercially or made by methods known to those skilled in the art.

EXAMPLES

The following non-limiting examples are illustrative of the invention but should not be construed as limitations thereon. Unless otherwise indicated, abbreviations and chemical symbols have their usual and customary meanings.

A laboratory investigation directed at enhancing the bleach response of mechanical pulps, which were either groundwood or thermomechanical, bleached with sodium dithionite or hydrogen peroxide was conducted. The laboratory investigation furnished comparative brightnesses relative to a MgO or $BaSO_4$ standard for handsheets bleached with and without the addition of various amine, quaternary amine, and phosphonium compounds. The data in the Examples was, in many cases, obtained as a result of averaging multiple readings on the same sample or on multiple samples. All percents are by weight, and the weight of pulp is on an oven-dried basis.

All the various amine, quaternary amine, and phosphonium compounds tested are commercially available except for the quaternary amine carbonate salts. The quaternary amine carbonate salts were synthesized by reacting the tertiary amine with approximately a three-fold molar excess of dimethyl carbonate using methanol as the reaction medium. The reaction mixture was sealed in a glass-lined autoclave. The autoclave was purged with nitrogen and heated to 150 degrees C. for eight hours. After cooling, the solvent and unreacted starting materials were removed from the product by rotoevaporation.

EXAMPLES 1–25

Sodium Hydrosulfite Bleaching of TMP

All sodium hydrosulfite bleaching studies were conducted on 9–10 gram samples of TMP wood pulp having a consistency of 3.5 percent (on an oven-dried basis). The samples were bleached at 60 degrees C. for sixty minutes at a pH of 4.5–5.5 with a 1–3 percent (weight/weight) aqueous solution of V-Brite® B, a proprietary blend composed of sodium hydrosulfite manufactured and sold by Hoechst Celanese Corporation. If a quaternary ammonium compound (also referred to as amine compound) was used, it was added to the bleach reactor just prior to the addition of the bleach solution. Handsheets were formed by diluting the 3.5 percent consistency bleached stock to 0.5 percent consistency, adjusting the pH of the dilute pulp slurry to 4.5, and filtering the slurry in a large fritted-glass funnel (course porosity) having the fritted surface covered with #4 Whatman filter paper. Each handsheet was then pressed and allowed to dry at 23 degrees C. and 50 percent relative humidity for no more than twenty-four hours. All pulp samples were obtained from sources outside the company.

EXAMPLE 1

A sample of southern pine pulp was prepared as described above, except that no bleach was used. A hand-sheet was made using the method described above in the introduction, and the brightness was measured. The data is recorded in Table I.

EXAMPLE 2

A sample of southern pine pulp was prepared as described above and was bleached at a 0.75 percent bleach dosage level with sodium hydrosulfite. A handsheet was made using the method described in Example 1. The brightness was measured, and the data is recorded in Table I.

EXAMPLES 3–16

For each Example a sample of southern pine pulp prepared as described above was bleached at a 0.75 percent bleach dosage with sodium hydrosulfite, and a 5 percent amine additive dosage. The identity of the amine additive is listed in Table I. Handsheets were made as described above in Example 1, and the brightness gain or loss (compared to Example 1) is listed in Table I for each Example. The brightness enhancement or loss (compared to Example 2) is also listed in Table I for each Example.

EXAMPLE 17

The method of Example 1 was repeated using a different source for the southern pine pulp. The data is recorded in Table II.

EXAMPLE 18

The method of Example 2 was repeated using the same source of southern pine as noted in Example 17. The data is recorded in Table II.

EXAMPLES 19–25

The method described for Examples 3–16 was repeated with the same type of southern pine pulp as was used for Example 17. The identity of the amine additive is listed in Table II). Handsheets were made as described above, and the brightness gain (compared to Example 17) is listed in Table II for each example. The brightness enhancement or loss (compared to Example 18) is also listed in Table II for each Example.

EXAMPLES 26–28

Sodium Hydrosulfite Bleaching of Sulfite Pulp

EXAMPLE 26

A sample of sulfite brownstock made by conventional techniques was obtained from a commercial mill and was processed as described above in Example 1. A handsheet was made using the method described in Example 1. The data is recorded in Table III.

EXAMPLE 27

A sample of sulfite brownstock as described in Example was bleached at a 0.5 percent bleach dosage level with sodium hydrosulfite. A handsheet was made using the method described in Example 1, and the brightness was measured. The data is recorded in Table III.

EXAMPLE 28

A sample of sulfite brownstock as described in Example was bleached at a 0.5 percent bleach dosage level with sodium hydrosulfite and a 1 percent quaternary amine salt additive dosage. A handsheet was made using the method described above, and the brightness was measured. The brightness gain (compared to Example 26) is listed in Table III. The brightness enhancement (compared to Example 27) also is listed in Table III.

EXAMPLES 29–31

Sodium Hydrosulfite Bleaching of Unbleached Softwood Kraft Pulp

EXAMPLE 29

A sample of kraft brownstock made from southern pine was processed as described above in Example 1. A handsheet was made using the method described in Example 1, and the brightness was measured. The data is recorded in Table IV.

EXAMPLE 30

A sample of kraft brownstock was processed as described in Example 29, and was bleached at a 1 percent bleach dosage level with sodium hydrosulfite. A handsheet was made using the method described in Example 1, and the brightness was measured. The data is recorded in Table IV.

EXAMPLE 31

A sample of kraft brownstock was processed as described in Example 29, and was bleached at a 1 percent bleach dosage level with sodium hydrosulfite and a 2 percent quaternary amine salt additive dosage. A handsheet was made using the method described in Example 1, and the brightness was measured. The brightness gain (compared to Example 29) is listed in Table IV. The brightness enhancement (compared to Example 30) also is listed in Table IV.

EXAMPLES 32–34

Sodium Hydrosulfite Bleaching of Unbleached Hardwood Kraft Pulp

EXAMPLE 32

A sample of hardwood kraft brownstock was processed as described above in Example 1. A handsheet was made using the method described in Example 1, and the brightness was measured. The data is recorded in Table V.

EXAMPLE 33

A sample of hardwood kraft brownstock was processed as described above in Example 32, and was bleached at a 1 percent bleach dosage level with sodium hydrosulfite prepared from V-Brite® 6000 (a proprietary blend manufactured and sold by Hoechst Celanese Corporation). A handsheet was made using the method described in Example 1, and the brightness was measured. The data is recorded in Table V.

EXAMPLE 34

A sample of kraft brownstock was processed as described in Example 32, and was bleached at a 1 percent bleach dosage level with sodium hydrosulfite and a 2 percent quaternary amine salt additive dosage. A handsheet was made using the method described in Example 1, and the brightness was measured. The brightness gain (compared to Example 32) is listed in Table V. The brightness enhancement (compared to Example 33) also is listed in Table V.

EXAMPLES 35–40

Sodium Hydrosulfite Bleaching of Semi-bleached Softwood Kraft Pulp

EXAMPLE 35

A sample of softwood kraft made from southern pine and treated by a proprietary OQ sequence (where O is an oxygen delignification step and Q is a chelate treatment) was obtained from a third party. The pulp sample was prepared as described for Example 1. A handsheet was made using the method described in Example 1, and the brightness was measured. The data is recorded in Table VI.

EXAMPLE 36

A sample of kraft OQ pulp was processed as described above in Example 35, and was bleached at a 1 percent bleach dosage level with sodium hydrosulfite prepared from V-Brite® 6000 blend. A handsheet was made using the method described in Example 1, and the brightness was measured. The data is recorded in Table VI.

EXAMPLE 37

A sample of kraft OQ pulp was processed as described in Example 35, and was bleached at a 1 percent bleach dosage level with sodium hydrosulfite and a 2 percent quaternary amine salt additive dosage. A handsheet was made using the method described in Example 1, and the brightness was measured. The brightness gain (compared to Example 35) is listed in Table VI. The brightness enhancement (compared to Example 36) also is listed in Table VI.

EXAMPLE 38

A sample of softwood kraft made from southern pine that was treated by a proprietary OQPAPA sequence (where O is an oxygen delignification step, Q is a chelate treatment, P is a peroxide bleaching step, and A is an acid washing step) was obtained from a third party. The pulp sample was prepared as described in Example 1. A handsheet was made using the method described in Example 1, and the brightness was measured. The data is recorded in Table VII.

EXAMPLE 39

A sample of kraft OQPAPA pulp as described in Example 38, and was prepared and was bleached at a 1 percent bleach dosage level with sodium hydrosulfite. A handsheet was made using the method described in Example 1, and the brightness was measured. The data is recorded in Table VII.

EXAMPLE 40

A sample of kraft OQPAPA pulp was prepared as described in Example 38, and was bleached at a 1 percent bleach dosage level with sodium hydrosulfite and a 2 percent quaternary amine salt additive dosage. A handsheet was made using the method described in Example 1, and the brightness was measured. The brightness gain (compared to Example 38) is listed in Table VII. The brightness enhancement (compared to Example 39) also is listed in Table VII.

EXAMPLES 41–44

Hydrogen Peroxide Bleaching of TMP

All hydrogen peroxide bleaching studies were conducted on 9 gram samples of TMP southern pine wood pulp. The unbleached pulp stock was diluted to 0.5 percent consistency and pretreated with a 0.5 percent diethylenetriaminepentaacetic acid pentasodium salt. The pretreated pulp stock was dewatered and adjusted to 12 percent consistency. The pulp was bleached with 1 percent hydrogen peroxide, 1 percent sodium hydroxide, 5 percent sodium silicate, 0.05 percent magnesium sulfate, and 2.5 percent quaternary ammonium compound (amine salt) at 55 degrees C. for 135 minutes. The bleached stock was adjusted to 3.5 percent consistency, and the residual hydrogen peroxide was neutralized with a sodium bisulfite solution. Handsheets were formed by diluting the stock to 0.5 percent consistency, adjusting the pH of the dilute pulp slurry to 4.5, and filtering the slurry in a large fritted-glass funnel (course porosity)

having the fritted surface covered with #4 Whatman filter paper. Each handsheet was then pressed and allowed to dry at 23 degrees C. and 50 percent relative humidity for no more than twenty-four hours.

EXAMPLE 41

A sample of southern pine pulp was processed (as described generally above for Examples 41–44), except that no bleach was used. A handsheet was made using the method described in the general information for Examples 41–44, and the brightness was measured. The data is recorded in Table VIII.

EXAMPLE 42

A sample of southern pine pulp was processed (as described generally above for Examples 41–44) and was bleached at a one percent bleach dosage. Handsheets were made as described in the general information for Examples 41–44. The brightness was measured, and the data is recorded in Table VIII.

EXAMPLES 43–44

Samples of southern pine pulp were processed (as generally described above for Examples 41–44) and were bleached at a one percent dosage with a 2.5 percent amine additive level used. The identity of the quaternary ammonium compound (amine additive) is listed in Table VIII. Handsheets were made as described in the general information for Examples 41–44, and the brightness was measured. The brightness gain (compared to Example 41) is listed in Table VIII for each Example. The brightness enhancement (compared to Example 42) is also listed in Table VIII.

TABLE I

| Example No. | Additive | Final Brightness | Brightness Gain | Enhancement |
|---|---|---|---|---|
| 1 | Unbleached | 48.0 | — | — |
| 2 | No additive | 58.9 | 10.9 | — |
| 3 | $NH_4Cl$ | 58.1 | 10.1 | −0.8 |
| 4 | $CH_3(CH_2)_7NH_2$ | 54.7 | 6.7 | −4.2 |
| 5 | $CH_3(CH_2)_{11}NH_2$ | 56.4 | 8.4 | −2.5 |
| 6 | $CH_3(CH_2)_{11}N(CH_3)_2$ | 60.9 | 12.9 | +2.0 |
| 7 | $(CH_2)_4NCl$ | 58.9 | 10.9 | 0 |
| 8 | $[CH_3(CH_2)_3]_4NBr$ | 59.7 | 11.7 | +0.8 |
| 9 | $CH_3(CH_2)_{11}N(CH_3)_3Br$ | 62.7 | 14.7 | +3.8 |
| 10 | $CH_3(CH_2)_{15}N(CH_3)_3Br$ | 61.0 | 12.9 | +2.1 |
| 11 | $[CH_3(CH_2)_{15}N(CH_3)_3]_2CO_3$ | 61.9 | 13.9 | +3.0 |
| 12 | $[CH_3(CH_2)_{17}N(CH_3)_3]_2CO_3$ | 61.2 | 13.2 | +2.3 |
| 13 | poly{[3-(methacryloylamino)propyl]trimethyl ammonium chloride} | 58.0 | 10.0 | −0.9 |
| 14 | poly(diallyldimethylammonium chloride) | 58.7 | 10.7 | −0.2 |
| 15 | $CH_3(CH_2)_{17}P[CH_2)_3CH_3]_3Br$ | 54.6 | 6.6 | −4.3 |
| 16 | $(C_6H_5)_4PBr$ | 55.9 | 7.9 | −3.0 |

TABLE II

| Example No. | Additive | Final Brightness | Brightness Gain | Enhancement |
|---|---|---|---|---|
| 17 | Unbleached | 54.6 | — | — |
| 18 | No additive | 59.3 | 4.7 | — |
| 19 | $H_2N(CH_2)_{12}NH_2$ | 59.7 | 5.1 | −0.4 |
| 20 | $[CH_3(CH_2)_9]_2NH$ | 57.2 | 2.6 | −2.1 |

TABLE II-continued

| Example No. | Additive | Final Brightness | Brightness Gain | Enhancement |
|---|---|---|---|---|
| 21 | $CH_3(CH_2)_7N(CH_3)_2$ | 64.8 | 10.2 | +5.5 |
| 22 | $CH_3(CH_2)_{11}N(CH_3)_3Br$ | 68.2 | 13.6 | +8.9 |
| 23 | $CH_3(CH_2)_{15}N(CH_3)(C_2H_5)Br$ | 64.4 | 9.8 | +5.1 |
| 24 | $(CH_3)_3N(CH_2)_{10}N(CH_3)_3Br_2$ | 64.9 | 10.3 | +5.6 |
| 25 | $C_5H_5N(CH_2)_{11}CH_3Cl$ | 66.4 | 11.8 | +7.1 |

TABLE III

| Example No. | Additive | Final Brightness | Brightness Gain | Enhancement |
|---|---|---|---|---|
| 26 | Unbleached | 52.2 | — | — |
| 27 | No additive | 4.4 | — | — |
| 28 | $CH_3(CH_2)_{15}N(CH_3)_3Br$ | 58.6 | 6.4 | +2.0 |

TABLE IV

| Example No. | Additive | Final Brightness | Brightness Gain | Enhancement |
|---|---|---|---|---|
| 29 | Unbleached | 29.6 | — | — |
| 30 | No Additive | 34.8 | 5.2 | — |
| 31 | $CH_3(CH_2)_{15}N(CH_3)_3Br$ | 37.7 | 8.1 | +2.9 |

TABLE V

| Example No. | Additive | Final Brightness | Brightness Gain | Enhancement |
|---|---|---|---|---|
| 32 | Unbleached | 30.9 | — | — |
| 33 | No Additive | 35.8 | 4.9 | — |
| 34 | $CH_3(CH_2)_{15}N(CH_3)_3Br$ | 38.3 | 7.4 | +2.5 |

TABLE VI

| Example No. | Additive | Final Brightness | Brightness Gain | Enhancement |
|---|---|---|---|---|
| 35 | Unbleached | 40.5 | — | |
| 36 | No Additive | 47.5 | 7.0 | — |
| 37 | $CH_3(CH_2)_{15}N(CH_3)_3Br$ | 51.6 | 11.1 | +4.1 |

TABLE VII

| Example No. | Additive | Final Brightness | Brightness Gain | Enhancement |
|---|---|---|---|---|
| 38 | Unbleached | 68.6 | — | — |
| 39 | No Additive | 72.7 | 4.1 | — |
| 40 | $CH_3(CH_2)_{15}N(CH_3)_3Br$ | 73.9 | 5.3 | +1.2 |

TABLE VIII

| Example No. | Additive | Final Brightness | Brightness Gain | Enhancement |
|---|---|---|---|---|
| 41 | Unbleached | 56.2 | — | — |
| 42 | No Additive | 65.5 | 9.3 | — |

TABLE VIII-continued

| Example No. | Additive | Final Brightness | Brightness Gain | Enhancement |
|---|---|---|---|---|
| 43 | $CH_3(CH_2)_{11}N(CH_3)_3Br$ | 66.4 | 10.2 | +0.9 |
| 44 | $CH_3(CH_2)_{15}N(CH_3)_3Br$ | 67.9 | 11.7 | +2.4 |

What is claimed is:

1. A process for brightening wood pulps bleached with an anionic bleaching agent selected from sodium dithionite, blends of sodium dithionite, zinc dithionite, hydrogen peroxide, and formamidine sulfinic acid wherein said bleaching is done in the presence of a quaternary ammonium compound selected from the group consisting of (a) compounds of Formula I:

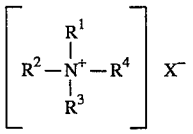

Formula I wherein:

$R^1$ is selected from the group consisting of hydrogen, methyl and ethyl, provided that $R^1$ cannot be hydrogen for peroxide bleaching;

$R^2$ and $R^3$ may be alike or different and are each selected from the group consisting of methyl and ethyl;

$R^4$ is an alkyl or alkenyl group having from 8 to 20 carbons, optionally having one to three substituents selected from methyl and ethyl;

X is selected from the group consisting of $HCO_3^{-1}$, $CO_3^{-2}$, $PO_4^{-3}$, $HPO_4^{-2}$, $H_2PO_4^{-1}$, $OH^{-1}$, $F^{-1}$, $Br^{-1}$, $Cl^{-1}$, $I^{-1}$, $HSO_3^{-1}$, $SO_3^{-2}$, $HSO_4^{-1}$, $SO_4^{-2}$, $S_2O_4^{-2}$, $CH_3CO_3^{-1}$ and $CH_3\ SO_4^{-1}$;

(b) compounds of Formula II:

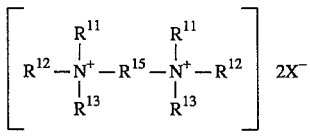

Formula II wherein:

$R^{11}$ is selected from the same group as described for $R^1$;

$R^{12}$ is selected from the same group as described for $R^2$;

$R^{13}$ is selected from the same group as described for $R^3$;

$R^{15}$ is an alkylene or alkenylene group having from 8 to 20 carbons, optionally having one to three substituents selected from methyl and ethyl;

n is an integer from 8–20;

(c) compounds of Formula III:

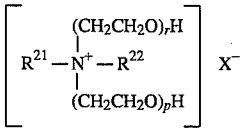

Formula III wherein $R^{21}$ is selected from the same group as defined for $R^4$;

$R^{22}$ is methyl or ethyl;

r and p each have a value of at least one and are selected independently and the sum of r+p equals an integer from 2 to 12 inclusive; and wherein said quaternary ammonium compound is added to a reactor in an amount of from 0.25 percent to 10 percent by weight based on the amount of oven dried pulp in the reactor.

2. A process as claimed in claim 1 wherein $R^1$ is selected from the group consisting of methyl and ethyl.

3. A process as claimed in claim 1 wherein $R^2$ and $R^3$ are each ethyl.

4. A process as claimed in claim 1 wherein $R^2$ is methyl and $R^3$ is ethyl.

5. A process as claimed in claim 1 wherein $R^2$ and $R^3$ are each methyl.

6. A process as claimed in claim 1 wherein $R^4$ and $R^{15}$ are each independently selected from a group containing 12–18 carbons.

7. A process as claimed in claim 6 wherein $R^4$ and $R^{15}$ are each independently selected from a group containing 16–18 carbons.

8. A process as claimed in claim 1 wherein said quaternary ammonium compound is added in an amount of from 0.25–10.0 percent by weight.

9. A process as claimed in claim 1 wherein said quaternary ammonium compound is added in an amount of from 0.5–5.0 percent by weight.

10. A process as claimed in claim 1 wherein said quaternary ammonium compound is added in an amount of from 0.5–2.0 percent by weight.

11. A process as claimed in claim 1 wherein X is selected from the group consisting of chloride, bromide, carbonate and bisulfate.

12. A process as claimed in claim 1 wherein said wood pulp is a high-yield wood pulp.

13. A process as claimed in claim 1 wherein said wood pulp is a refiner mechanical pulp.

14. A process as claimed in claim 1 wherein said wood pulp is a thermomechanical pulp.

15. A process as claimed in claim 1 wherein said wood pulp is a groundwood pulp.

16. A process as claimed in claim 1 wherein said wood pulp is a chemical pulp.

17. A process as claimed in claim 1 wherein said wood pulp is a kraft pulp.

18. A process as claimed in claim 1 wherein said wood pulp is a sulfite pulp.

19. A process as claimed in claim 1 wherein said quaternary ammonium compound is selected from the group consisting of $[CH_3(CH_2)_3]_4NBr$, $CH_3(CH_2)_{11}N(CH_3)_3Br$, $CH_3(CH_2)_{15}N(CH_3)_3Br$, $[CH_3(CH_2)_{15}N(CH_3)_3]_2CO_3$, $[CH_3(CH_2)_{17}N(CH_3)_3]\ _2CO_3$, $CH_3(CH_2)_{11}N(CH_3)_3Br$, $CH_3(CH_2)_{15}N(CH_3)_2(C_2H_5)Br$, $(CH_3)_3N(CH_2)_{10}N(CH_3)_3Br_2$, and $CH_3(CH_2)_{15}N(CH_3)_3Br$.

* * * * *